US007232791B2

(12) United States Patent
Nagai et al.

(10) Patent No.: US 7,232,791 B2
(45) Date of Patent: Jun. 19, 2007

(54) MULTICOLORED THERMALLY RECORDING MEDIUM

(75) Inventors: Tatsuo Nagai, Tokyo (JP); Kaoru Hamada, Tokyo (JP); Tadakazu Fukuchi, Tokyo (JP); Takashi Sasaki, Tokyo (JP)

(73) Assignee: Nippon Paper Industries, Co., Ltd., Tokyo (JP)

( * ) Notice: Subject to any disclaimer, the term of this patent is extended or adjusted under 35 U.S.C. 154(b) by 541 days.

(21) Appl. No.: 10/505,021

(22) PCT Filed: Feb. 28, 2003

(86) PCT No.: PCT/JP03/02349

§ 371 (c)(1),
(2), (4) Date: Aug. 19, 2004

(87) PCT Pub. No.: WO03/074286

PCT Pub. Date: Sep. 12, 2003

(65) Prior Publication Data

US 2006/0072429 A1 Apr. 6, 2006

(30) Foreign Application Priority Data

Mar. 4, 2002 (JP) ..... 2002-057675

(51) Int. Cl.
*B41M 5/323* (2006.01)

(52) U.S. Cl. ..... 503/204; 503/214

(58) Field of Classification Search ..... None
See application file for complete search history.

(56) References Cited

U.S. PATENT DOCUMENTS 6,680,281 B2 * 1/2004 Tajiri et al. ..... 503/209

FOREIGN PATENT DOCUMENTS

| | | | |
|---|---|---|---|
| JP | 2001-18529 | * | 1/2001 |
| JP | 2001-1138360 | * | 4/2001 |
| JP | 2001-239760 | * | 9/2001 |
| JP | 2002-002115 | * | 1/2002 |

* cited by examiner

*Primary Examiner*—Bruce H. Hess
(74) *Attorney, Agent, or Firm*—Sherman & Associates

(57) ABSTRACT

In the multi colored thermally sensitive recording medium, at least one kind of dye precursor is contained in complex fine particles which contain dye precursor and polymer of multi valence isocyanate compound, further contain 4,4'-diisocyanate-3,3'-dimethyl-1,1'biphenyl and/or polymethylene.polyphenyl.polyisocyanate.

4 Claims, No Drawings

MULTICOLORED THERMALLY RECORDING MEDIUM

FIELD OF THE INVENTION

The present invention relates to the multi colored thermally sensitive recording medium which uses complex fine particles which is composed of dye precursor and polymer substance.

BACKGROUND OF THE INVENTION

The thermally sensitive recording method is the method to obtain recorded image by providing a thermally sensitive color developing layer mainly composed of colorless or pale colored electron donning type dye precursor and electron accepting type color developer on a substrate and by reacting said dye precursor and color developer instantly with heat using thermal head, thermal pen or laser beam, and is disclosed in Japanese Patent Laid-Open publication 43-4160 or Japanese Patent Laid-Open publication 45-14039. This kind of thermal recording method does not need a developing and fixing processes and very shape image can be obtained by simple equipment. Further, the equipment has the advantageous of relatively cheap, compact and maintenance free and noiseless. Therefore, this method is widely applied in the field of a facsimile, a printer, a recorder of measuring instrument, a labeling machine and for a bending machine for train tickets. Along with the expanding of the usage, the required qualities to a thermally sensitive recording medium are becoming more multiplex, for instance, a higher sensitivity, a stabilization of image and a multi coloration of image can be mentioned. Especially, the multi coloration of recorded image has a merit that the letters or patterns to be emphasized can be recorded by a different color tone from the other part.

As a multi chromatic thermally sensitive recording medium, following two types are known. That is, one is a laminated layers type which prepares plural color developing layers that develop different colors on a substrate and to form a recording image using variations of heating temperature or thermal energy, and another one is a single layer type which contains two or more colors precursors which develop different color in same color developing layer.

The multi layered type is characterized to laminate a high temperature color developing layer and a lower temperature color developing layer which develops color by lower temperature range or by lower thermal energy than the high temperature color developing layer, and multi colored by color erasing or color adding. Color developing mechanism in color erasing type can be illustrated as follows. That is, only lower temperature color developing layer develops color by lower temperature heating and at the higher temperature heating, a color erasing agent which has color erasing function to color developing line of the lower temperature color developing layer acts so that only high temperature color developing layer develops color. This method has an advantage that the color developing tone can be voluntarily selected, however, for the purpose to obtain enough color erasing effect, it is necessary to add large amount of color erasing agent, and too much adding of the color erasing agent deteriorate the preservability of the recorded image. Further, since a lot of thermal energy is wasted to fuse the color erasing agent, the problem that the recording sensitivity is deteriorated causes.

In the case of color adding type, a lower temperature color developing layer develops color by lower temperature and a high temperature color developing layer develops color by higher temperature, namely, since these color developing layers develop color simultaneously and colors of these two layers are obtained by mixing, it is necessary to restrict substantially the color of high temperature color developing layer to black. Further, since the black color image of high temperature color developing layer is obtained by mixing with color developing line of lower temperature color developing layer, the color of lower temperature color developing layer is fogged to black color image and the difference between developed color tone become unclear, in particular, the color mixing becomes remarkable at the outermost periphery and becomes difficult to obtain clear black color. Further, when exposed in the high temperature environment such as on a dashboard of car, following problems, namely, the high temperature color developing layer develops color and fogs on the developed color tone by lower temperature, or color becomes black, are caused.

In the case of single layered multi colored thermally sensitive recording medium, the use of micro capsule is known. In Japanese Patent Laid-Open Publication 60-242093, the art to contain different color developing components in two or more kind of micro capsules whose glass transition point are different. In Japanese Patent Laid-Open Publication 4-101855, the method to form a micro capsule is disclosed. That is, the solution prepared by dissolving dye precursor and wall forming material of microcapsule in water insoluble organic solvent, is emulsified and dispersed in hydrophilic colloidal solution, then the system is heated and the inner pressure of a reacting vessel is vacuumed so as to evaporate off the organic solvent and to form the wall of micro capsule.

However, in the case of above mentioned Japanese Patent Laid-Open publication 60-242093, when the dyes which develop different colors are micro capsuled separately, since these dyes are completely isolated by wall of capsule, the color developing sensitivity are deteriorated and the color isolation feature becomes bad. Further, the micro capsule obtained by the method disclosed in Japanese Patent Laid-Open Publication 4-101855, is easily crushed by pressure. The micro capsule of Japanese Patent Laid-Open Publication 9-76634 is illustrated as follows. That is, the micro capsule is prepared by making a dye as a solute, and oily solution whose solvent is organic solvent is emulsified and dispersed in aqueous solution and to form a wall film composed of polymer surrounding an oily drop. However, in the case of micro capsule which uses organic solvent, the color developing reaction of leuco dye with color developing agent is caused through organic solvent, and causes the problem of deterioration of the ground color or becoming dirty by friction. Still further, the micro capsule of Japanese Patent Laid-Open Publication 4-101855 containing solid state dye precursor is easily crushed and is inferior in ground color and resistance to friction, and is not sufficient to obtain a multi colored thermally sensitive recording medium having enough quality.

For the purpose to supplement the defect of the conventional micro capsule, in Japanese Patent Laid-Open Publication 9-102025 and Japanese Patent Laid-Open Publication 9-290565, the method to use complex fine particle obtained by complexing dye precursor with polymer compound composed of poly urea or polyurethane. However, although this method can dissolve the problem of capsule destruction, this method is not sufficient for the purpose to obtain clear lower temperature developed image and clear high temperature developed image.

Concerning above mentioned circumference, the subject of the present invention is to provide a multi colored thermally sensitive recording medium which can obtain clear color tone both is lower temperature color development and higher temperature color development, no fogging at lower temperature color developing tone and high temperature color developing tone and is excellent in color isolation.

DISCLOSURE OF THE INVENTION

For the purpose to dissolve the above mentioned problems the inventors of the present invention continued ardent study and have accomplished the present invention by using complex fine particles of specific dye precursor.

That is, the present invention is a multi colored thermally sensitive recording medium comprising, a thermally sensitive recording layer containing two or more kinds of colorless or pale colored dye precursors which develop different color tones and organic color developing agent which develops color by reacting with said dye precursor provided on a substrate, wherein at least one of said dye precursors is contained in complex fine particles which contain dye precursor and polymer of multi valence isocyanate compound, and said thermally sensitive recording layer further said thermally sensitive recording layer contains 4,4'-diisocyanate-3,3'-dimethyl-1,1'biphenyl and/or polymethylene.polyphenyl.polyisocyanate as said multi valence isocyanate compound.

In a multi colored thermally sensitive recording medium which can obtain two or more different color tones by height of thermal energy, various combinations of color tones can be possible, and the combination of black color which develops color by higher temperature and other color which develops color by lower temperature is easy to control. For example, in the case of two colors combination of blue-black, blue color is developed former at lower temperature range, then black color is developed at higher temperature range. Further, in the case of two colors combination of red-black, red color is developed former at lower temperature range, then black color is developed at higher temperature range. In the case of blue-black color developing, since color tones of blue and black are relatively similar, a little fogging of each color does not affect so largely and color isolation is not hurt. On the contrary, in the case of red-black colors developing whose color tones are quite different, vividness of red color image is spoiled and beautiful red color can not be obtained and color isolation is deteriorated. Therefore, for the purpose to obtain vivid color tone on the lower temperature developing color, which is largely different from black color, further investigation is needed.

In the present invention, complex fine particles which contain dye precursor and polymer of multi valence isocyanate compound is used, and said complex fine particles are preferably used as the color developing component which develops color at higher temperature range. And the present invention is accomplished by finding out that above mentioned problem can be dissolved by using at least one compound selected from the group consisting of 4,4'-diisocyanate-3,3'-dimethyl-1,1'biphenyl and polymethylene.polyphenyl.polyisocyanate.

The reason why is not obvious, however, is conjectured as follows. That is, 4,4'-diisocyanate-3,3'-dimethyl-1,1'biphenyl and polymethylene.polyphenyl.polyisocyanate possess biphenyl skeleton or diphenylmethane skeleton, and these skeletons are characterized that the linear part is few in the structure and mainly composed by benzene skeleton. Therefore, these compounds are not vibrated easily by heat and are stable, further the heat resistance of complex fine particles is improved so that the complex fine particles which develops color adequately at higher temperature range. And because the complex fine particles have adequate heat resistance, the multi colored thermally sensitive recording medium having sharper thermal sensitive characteristic can be obtained and the color isolation is improved.

DESCRIPTION OF THE PREFERRED EMBODYMENT

The present invention will be illustrated more in detail.

In the first, the method for preparation of complex fine particles containing dye precursor and polymer of multi valence isocyanate compound is illustrated as follows. As the dye precursor, any public known compounds can be used, and specifically following compounds can be mentioned.

<Black color developing dye precursor>

3-diethylamino-6-methyl-7-anilinofluoran
3-diethylamino-6-methyl-7-(o,p-dimethylanilino)fluoran
3-diethylamino-6-methyl-7-(m-trifluoromethylanilino)fluoran
3-diethylamino-6-methyl-7-(o-chloroanilino)fluoran
3-diethylamino-6-methyl-7-(p-chloroanilino)fluoran
3-diethylamino-6-methyl-7-(o-fluoroanilino)fluoran
3-diethylamino-6-methyl-7-(m-methylanilino)fluoran
3-diethylamino-6-methyl-7-n-octylanilinofluoran
3-diethylamino-6-methyl-7-benzylaminofluoran
3-diethylamino-6-methyl-7-dibenzylaminofluoran
3-diethylamino-6-ethoxyethyl-7-anilinofluoran
3-diethylamino-7-(m-trifluoromethylanilino)fluoran
3-diethylamino-7-(o-chloroanilino)fluoran
3-diethylamino-7-(p-chloroanilino)fluoran
3-diethylamino-7-(o-fluoroanilino)fluoran
3-dibutylamino-6-methyl-7-anilinofluoran
3-dibutylamino-6-methyl-7-(o,p-dimethylanilino)fluoran
3-dibutylamino-6-methyl-7-(o-chloroanilino)fluoran
3-dibutylamino-6-methyl-7-(p-chloroanilino)fluoran
3-dibutylamino-6-methyl-7-(o-fluoroanilino)fluoran
3-dibutylamino-6-methyl-7-(m-trifluoromethylanilino)fluoran
3-dibutylamino-6-ethoxyethyl-7-anilinofluoran
3-dibutylamino-6-methyl-7-(p-methylanilino)fluoran
3-dibutylamino-7-(o-chloroanilino)fluoran
3-dibutylamino-7-(o-fluoroanilino)fluoran
3-di-n-pentylamino-6-methyl-7-anilinofluoran
3-di-n-pentylamino-6-methyl-7-(p-chloroanilino)fluoran
3-di-n-pentylamino-7-(m-trifluoromethylaniliono)fluoran
3-di-n-pentylamino-6-chloro-7-anilinofluoran
3-di-n-pentylamino-7-(p-chloroanilino)fluoran
3-pyrrolidino-6-methyl-7-anilinofluoran
3-piperidino-6-methyl-7-anilinofluoran
3-(N-methyl-N-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino)fluoran
3-(N-ethyl-p-toluidino)-6-methyl-7-anilinofluoran
3-(N-ethyl-N-isoamylamino)-6-methyl-7-anilinofluoran
3-(N-ethyl-N-tetrahydrofurfurylamino)-6-methyl-7-anilinofluoran
3-(N-ethyl-N-ethoxypropylamino)-61-methyl-7-anilinofluoran 2-chloro-3-meth-6-p-(p-phenylaminophenyl)aminoanilinofluoran
2-chloro-6-p-(p-dimethylaminophenyl)aminoanilinofluoran
3,3-bis-[2-(p-dimethylaminophenyl)-2-(p-methoxyphenyl)ethenyl]-4,5,6,7-tetra bromophthalide
3,3-bis-[2-(p-dimethylaminophenyl)-2-(p-methoxyphenyl)ethenyl]-4,5,6,7-tetra chlorophthalide
3,3-bis-[1,1-bis(4-pyrrolidinophenyl)ethylen-2-yl]-4,5,6,7-tetrabromo phthalide
3,3-bis-[1-(4-methoxyphenyl)-1-(4-pyrrolidinophenyl)ethylene-2-yl]-4,5,6,7-tetrachlorophthalide
3-diethylamino-6-chloro-7-anilinofluoran
3-diethylamino-6-chloro-7-p-methylanilinofluoran
3-dibutylamino-6-chloro-7-anilinofluoran
3-(N-ethyl-N-isoamylamino)-6-chloro-7-anilinofluoran
3-diethylamino-7-methylaminofluoran
<Blue color developing dye precursor>
3,3-bis(p-dimethylaminophenyl)-6-dimethylaminophthalide
3,3-bis(p-dimethylaminophenyl)phthalide
3,3-bis(p-diethylaminophenyl)-6-dimethylaminophthalide
3,3-bis(p-dimethylaminophenyl)-6-di-n-propylaminophthalide tris(4-dimethylaminophenyl)methane
3-diethylamino-6-methyl-7-n-octylaminofluoran,
3-diethylamino-6-methyl-7-benzylaminofluoran
3-diethylamino-7-dibenzylaminofluoran
3-diethylamino-6-methyl-7-diphenylmethylaminofluoran
3-diethylamino-7-dinaphtylmethylaminofluoran
3-(4-diethylamino-2-ethoxyphenyl)-3-(1-ethyl-2-methylindol-3-yl)-4-aza phthalide
3-(4-diethylamino-2-ethoxyphenyl)-3-(1-octyl-2-methylindol-3-yl)-4-aza phthalide
3-(4-cyclohexylethylamino-2-methoxyphenyl)-3-(1-ethyl-2-methylindol-3-yl)-4-azaphthalide
3-(4-cyclohexylmethylamino-2-methoxyphenyl)-3-(1-ethyl-2-methylindol-3-yl)-4-azaphthalide
3-(4-diethylamino-2-hexyloxyphenyl)-3-(1-ethyl-2-methylindol-3-yl)-4-aza phthalide
<Green color developing dye precursor>
3-diethylamino-7-anilinofluoran 3-diethylamino-6-methyl-7-dibenzylanilinofluoran
3-diethylamino-5-methyl-7-dibenzylanilinofluoran
3-(N-ethyl-N-hexylamino)-7-anilinofluoran
3-pyrrolidino-7-cyclohexylaminofluoran
3-diethylamino-7-cyclohexylaminofluoran
3-(N-p-tolyl-N-ethylamino)-7-(N-methyl-N-phenylamino)fluoran
3-diethylamino-7-(N-methyl-N-phenylamino)fluoran
3-diethylamino-7-octylaminofluoran
3-diethylamino-7-(N-cyclohexyl-N-benzylamino)fluoran
3-diethylamino-7-(di-p-chlorobenzylamino)fluoran
3-(N-ethyl-N-hexylamino)-7-(N-methyl-N-phenylamino)fluoran
3-pyrrolidil-7-dibenzylfluoran
3-dibutylamino-7-(o-chlorobenzylamino)fluoran
3-diethylamino-6-ethoxyethyl-7-anilinofluoran
<Red color developing dye precursor>
3-diethylamino-6-methyl-7-chlorofluoran
3-diethylamino-7-chlorofluoran
3-diethylamino-6-methylfluoran
3-diethylamino-7-methylfluoran
3-diethylamino-benzo[a]fluoran
10-diethylamino-4-dimethylamino-benzo[a]fluoran
3-diethylamino-7-(di-p-methylbenzylamino)fluoran
3-diethylamino-6-methyl-7-dibenzylaminofluoran
3-diethylamino-7-methylfluoran
3-(N-ethyl-N-isoamylamino)-benzo[a]fluora
3-(N-ethyl-N-p-toluilamino)-7-methylfluoran
3-diethylamino-6-chloro-7-methylfluoran
3-dibutylamino-6-methylfluoran
3-dibutylamino-6-methyl-7-chlorofluoran
3-cyclohexylamino-6-chlorofluoran
3-diethylamino-6,8-dimethylfluoran
3-dibutylamino-6-methyl-7-bromofluoran
3,6-bis(diethylamino)fluoran-γ-(4'-nitro).anilinolactam
3,3-bis(1-ethyl-2-methylindol-3-yl)phthalide
3,3-bis(1-n-butyl-2-methylindol-3-yl)phtalide
3,6-bis(diethylamino)fluoran-γ-anilinolactam These dye precursor can be used alone or can be used together with. In the present invention, black color dye precursor is suited because multi colored thermally sensitive recording medium having good color developing ability can be obtained, in particular, 3-(N-isopentyl-N-ethylamino)-6-methyl-7-anilinofluoran <S-205>, and
3-(N-isobutyl-N-ethylamino)-6-methyl-7-anilinofluoran <PSD-184> are desirably used.

In the present invention, at least one compound selected from the group consisting of 4,4'-diisocyanate-3,3'-dimethyl-1,1'biphenyl and polymethylene.polyphenyl.polyisocyanate is contained. These compounds are contained from 5 wt % to 50 wt %, desirably from 10 wt % to 40 wt % to total weight of multi valence isocyanate.

Polymethylene.polyphenyl.polyisocyanate used in the present invention is the mixture represented by following general formula (1) whose main component is the compound represented by general formula (1) wherein n is from 0 to 4. Specifically, Millionate MR-100, Millionate MR-200 or Millionate MR-400, which are the products of Nihon Polyurethane Industries Co., Ltd.

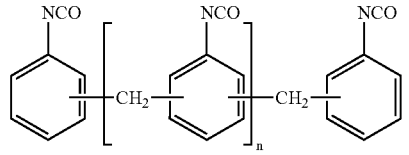

(1)

Multi valence isocyanate compound to be used besides 4,4'-diisocyanate-3,3'-dimethyl-1,1'biphenyl and polymethylene.polyphenyl.polyisocyanate, is the compound which forms polyurea or polyurethane-polyurea by reacting with water, or can be multi valence isocyanate compound alone, or can be a mixture of multi valence isocyanate compound and polyol which reacts with it or polymer such as multi valence isocyanate compound and adduct of polyol, burettes or isocyanurates.

For example, as the specific example of multi valence isocyanate compound, diisocyanates such as m-phenylenediisocyanate,
p-phenylenediisocyanate,
2,6-tolylenediisocyanate,
2,4-tolylenediisocyanate,
naphthalene-1,4-diisocyanate,
diphenylmethane-4,4'-diisocyanate,
dicyclohexylmethane-4,4'-diisocyanate,
5-isocyanate-1-(isocyanatemethyl)-1,3,3-trimethylcyclohexane,
1,3-bis(isocyanatemethyl)cyclohexane,
tetramethylxylilenediisocyanate,
3,3'-dimethyldiphenylmethane-4,4'-diisocyanate,
xylilene-1,4-diisocyanate,
4,4'diphenylpropanediisocyanate, trim ethylen diisocyanate,
hexamethylenediisocyanate,
propylene-1,2-diisocyanate,
butylene-1,2-diisocyanate,
cyclohexylen-1,2-diisocyante or
cyclophexylene-1,4-diisocyanate,
triisocyanates such as 4,4',4"-triphenylmethanetriisocyanate or toluene-2,4,6-triisocyanate,
tetraisocyanates such as 4,4'-dimetyldiphenylmethane-2,2',5,5'-tetraisocyanate can be mentioned.

As the adduct of multi valence isocyanate compound and polyol, for example, isocyanate prepolymer such as trimethylolpropane adduct of hexamethylene diisocyanate, trimethylolpropane adduct of 2,4-tolylenediisocyanate, trimethylolpropane adduct of xylilenediisocyanate or hexanetriol adduct of trilenediisocyanate can be used. Further, multi valence isocyanate compound such as biurets of hexamethylene diisocyanate or polymer such as isocyanurate can be used in the present invention. These compounds can be used alone or can be used together with. Among these compounds, it is desirable to contain at least one multi valence isocyanate compound selected from the group consisting of xylilenediisocyanate, trimethylolpropane adduct of xylilenediisocyanate, hexamethylenediisocyanate, trimethylolpropane adduct of hexamethylenediisocyanate and dicyclohexylmethanediisocyanate.

And as the specific example of polyol compound, for example, fatty acid triol such as ethyleneglycol, 1,3-propanediol, 1,4-butanediol, 1,5-pentanediol, 1,6-hexanediol, 1,7-heptanediol, 1,8-octanediol, propyleneglycol, 2,3-dihydroxybutane, 1,2-dihydroxybutane, 1,3-dihydroxybutane, 2,2-dimethyle-1,3-prop anediol, 2,4-pentanediol, 2,5-hexanediol, 3-methyl-1,5-pentanediol, 1,4-cyclohexanedimethanol, dihydroxycyclohexane, diethylenglycol, 1,2,6-trihydroxyhexane, phenylethyleneglycol, 1,1, 1-trimethylolpropane, hexanetriol, pentaerythritol or glyceline,
condensed product of aromatic polyhydric alcohol and alkylene oxide such as, 1,4-di(2-hydroxyethoxy)benzene or
1,3-di(2-hydroxyethoxy)benzene,
p-xylileneglycol,
m-xylilenglycol,
α,α'-dihydroxy-p-diisopropylbenzene,
4,4'-dihydroxydiphenylmethane,
2-(p,p'-dihydroxydiphenylmethyl)benzyl alcohol,
4,4'-isopropylidendiphenol,
4,4'-dihydroxydiphenylsulfone,
4,4'-dihydroxydiphenylsulfide,
ethylneoxide adduct of 4,4'-isopropylidenediphenol,
propyleneoxide adduct of 4,4'-isopropylidenediphenol
and acrylate having hydroxyl group in molecule such as 2-hydroxy acrylate can be mentioned.

As the polyamine compound, for example, ethylenediamine, trimethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine and amine adduct of epoxy compound can be mentioned. Of cause, these polyol compound or polyamine compound are not limited to above mentioned compounds, and two or more can be used together with, when need is arisen.

As the solvent to dissolve these materials, ethylacetate, methylacetate, butylacetate, methylenechloride, butylchloride or propylchloride can be mentioned. Among these solvents, the solvent which dissolves dye precursor or multi valence isocyanate compound sufficiently is preferably used.

And, to the complex fine particles of dye precursor, alcohols such as n-butanol or ethylene glycol, UV absorbing agent such as benzotriazols, benzophenons, salicylic acids or benzooxadinons, or anti oxidant agent such as hindered amines or hindered phenols can be contained. Further, aiming to improve the color developing sensitivity, a sensitizer which is public known in the field of thermally sensitive recording materials can be added.

Further, the containing of the resin whose melting point or softening point is within the range from 50° C. to 150° C., is effective to restrain the fogging of color tone developed at the higher temperature to the color tone developed at the lower temperature. As the specific example of such kind of resin, thermoplastic resin can be used, and specifically, polystyrene, polyethylene, polypropylene, polybuthadiene, polyvinylacetate, ethylene-acetic acid copolymer resin, etylene.vinyl acetate-vinyl chloride graft copolymer resin, vinylidene chloride resin, vinyl chloride resin, chlorinated vinyl chloride resin, chlorinated polypropylene resin, phenoxy resin, fluoro resin, polyacetal resin, polyamide resin, polyamideimide resin, polyallylate resin, thermo plastic polyimide resin, polyetherimide resin, polyetheretherketone, polyethylenetrephathalate, polybutyleneterephthalate, polycarbonate resin, polysulfone resin, polyparamethylstyrene resin, polyphenyleneether, polyphenylenesulphite resin, methacrylate resin, ionomer resin, AAS resin, AES resin, AS resin, ABS resin, ACS resin or MBS resin can be mentioned. Among these resins, since the resin whose softening temperature is 80-120° C. has excellent effect, desirably used. Especially, polystyrene is characterized to have good solubility of dye precursor and complex fine particles of it is superior in heat responsibility, therefore is most desirably used. In the present invention, the term of "softening temperature" is described in "Physical and Chemical Dictionary" (Iwanami Shoten, $4^{th}$ edition, Jul. 4, 1998), and means the temperature which indicates the softened state with remarkable fluidity by temperature elevation. The containing ratio of the resin whose melting point or softening point is within the range of 50-150° C. can be adjusted along with the required efficiency level. When the containing amount is too small, the function of the resin can not be displayed sufficiently and when the containing amount is too much, the formation of the complex fine particles with adequate particle size becomes difficult. In the present invention, the contents of the resin is 10 wt % or more, desirably 25 wt % or more to 1 part of multi valence isocyanate compound, and is 400 wt % or less, desirably 100 wt % or less to 1 part of multi valence isocyanate compound.

The complex fine particles of the present invention can be prepared by using above mentioned materials and according to the following process. For example, dye precursor, multi valence isocyanate compound and other contents if necessary are dissolved in low boiling point water insoluble organic solvent, then the obtained solution is emulsified in water dispersible medium in which protective colloid is dissolved. Further, a reactive compound such as polyamine is mixed when the need is arisen, then the obtained emulsion is heated so as to polymerize these polymer forming materials, thus the complex fine particles can be obtained.

Specifically, for example, dye precursor and multi valence isocyanate compound are poured into organic solution of having 100° C. or less melting point at 30° C.-100° C. and dissolved, then emulsified using an emulsifier. The emulsification is carried out by 10000 R.P.M. rotating speed for 10 minutes or less. As an emulsifier to be used, any kind of public known emulsifier can be used, however, polyvinyl alcohol is most desirably use.

Then, organic solvent is evaporated off by heating at 50° C.-100° C. for 1-3 hours, and multi valence isocyanate compound is polymerized by reacting by said temperature for another 1-3 hours. After cooling down to room temperature, dispersion of complex fine particles can be prepared.

As the other method, following method can be mentioned. Tat is, using multi valence isocyanate compound as solvent, and solute containing dye precursor is dissolved in said solvent. Then emulsifying the obtained solution into aqueous solution of hydrophilic colloid and to participate the polymerization reaction of the multi valence isocyanate compound.

The average particle size of the obtained complex fine particles is 0.1 μm-10.0 μm, desirably finer than 1 μm because the color developing sensitivity is improved.

Further, in the present invention, for the purpose of obtain more high density and clear image at higher temperature (or higher energy), it is considered that the increase of the contents of dye precursor is effective, and the contents of dye precursor to the total weight of the complex fine particles is 40 wt % or more, desirably 55 wt % or more and 80 wt % or less, desirably 75 wt % or less.

While, when the contents of dye precursor in complex fine particles becomes too much, color development of complex fine particles causes by lower temperature or lower energy which develops color tone of lower temperature developing color tone and fogs to the lower temperature developing color tone and deteriorate the vividness of lower temperature developing color tone and deteriorate the color isolation. On the contrary, in the present invention, by containing specific compound as the isocyanate compound, the color development of complex fine particles is restrained at the lower temperature or lower energy recording and vivid lower temperature developing color tone can be obtained, further, at the higher temperature or higher energy recording, dye precursor contained in complex fine particles develops vivid color, thus the thermally sensitive recording medium which develops vivid color tone can be obtained.

In the thermally sensitive recording layer of the multi colored thermally sensitive recording medium of the present invention, above mentioned complex fine particles and dye precursor which develops different color from the dye precursor contained in said complex fine particles are contained in a thermally sensitive recording layer. This dye precursor is desirable to develop color by lower temperature than the complex fine particles, and is preferably selected from the conventional public known dye precursors such as previously mentioned dye precursors. These dye precursors can be used same as to the method used in conventional thermally sensitive recording medium, that is, dispersed by solid fine particles state.

The electron accepting organic compound used in the thermally sensitive recording medium of the present invention, public known organic color developer in the technical field of thermally sensitive record can be used, for example, bisphenol A, 4-hydroxybenzoic acid esters, phthalic acid monoesters, bis-(hydroxyphenyl)sulfides, 4-hydroxyphenylarylsulfones, 4-hydroxyphenylarylsulfonates, 1,3-di[2-(hydroxyphenyl)-2-propyl]benzenes, 4-hydroxybenzoyloxybenzoates or bisphenolsulfones which are mentioned in Japanese Patent Laid-open Publication 3-207688 or in Japanese Patent Laid-open Publication 5-24366, aminobenzenesulfoneamide derivatives mentioned in Japanese Patent Laid-open Publication 8-59603 or diphenylsulfone bridgeable compound mentioned in International Publication WO97/16420 can be mentioned, however, not intending to be limited to these compounds. These color developer can be used alone or can be used together with.

<Bisphenol A type>
4,4'-isopropylidenediphenol (another name is bisphenol A)
4,4'-cyclohexylidenediphenol
p,p'-(1-methyl-normalhexylidene)diphenol
1,7-di(hydroxyphenylthio)-3,5-dioxaheptane
<4-hydroxybenzoic acid ester type>
4-hydroxybenzyl benzoate
4-hydroxyethyl benzoate
4-hydroxypropyl benzoate
4-hydroxyisopropyl benzoate
4-hydroxybutyl benzoate
4-hydroxyisobutyl benzoate
4-hydroxymethylbenzyl benzoate.
<4-hydroxyphthalic acid diester type>
4-hydroxydimethylphthalate
4-hydroxydiisopropylphthalate
4-hydroxydibenzylphthalate
4-hydroxydihexylphthalate
<phthalic acid monoester type>
monobenzyl phthalate
monocyclohexyl phthalate
monophenyl phthalate
monomethylphenyl phthalate
monoethylphenyl phthalate
monopropylbenzyl phthalate
monohalogenbenzyl phthalate
monoethoxybenzyl phthalate
<Bis-(hydroxyphenyl)sulfide type>
bis-(4-hydroxy-3-tert-butyl-6-methylphenyl)sulfide
bis-(4-hydroxy-2,5-dimethylphenyl)sulfide
bis-(4-hydroxy-2-methyl-5-ethylphenyl)sulfide
bis-(4-hydroxy-2-methyl-5-isopropylphenyl)sulfide
bis-(4-hydroxy-2,3-dimethylphenyl)sulfide
bis-(4-hydroxy-2,5-dimethylphenyl)sulfide
bis-(4-hydroxy-2,5-diisopropylphenyl)sulfide
bis-(4-hydroxy-2,3,6-trimethylphenyl)sulfide
bis-(2,4,5-trihydroxyphenyl)sulfide
bis-(4-hydroxy-2-cyclohexyl-5-methylphenyl)sulfide
bis-(2,3,4-trihydroxyphenyl)sulfide
bis-(4,5-dihydroxy-2-tert-butylphenyl)sulfide
bis-(4-hydroxy-2,5-diphenylphenyl)sulfide
bis-(4-hydroxy-2-tert-octyl-5-methylphenyl)sulfide
<4-hydroxyphenylarylsulfone type>
4-hydroxy-4'-isopropoxydiphenylsulfone
4-hydroxy-4'-n-propoxydiphenylsulfone
4-hydroxy-4'-n-butyloxydiphenylsulfone
<4-hydroxyphenylarylsulfonate type>
4-hydroxyphenylbenzenesulfonate
4-hydroxyphenyl-p-tolylsulfonate
4-hydroxyphenylmethylenesulfonate
4-hydroxyphenyl-p-chlorobenzenesulfonate
4-hydroxyphenyl-p-tert-butylbenzenesulfonate
4-hydroxyphenyl-p-isopropoxybenzenesulfonate
4-hydroxyphenyl-1'-naphthalenesulfonate
4-hydroxyphenyl-2'-naphthalenesulfonate
<1,3-di[2-(hydroxyphenyl)-2-propyl]benzene type>
1,3-di[2-(4-hydroxyphenyl)-2-propyl]benzene
1,3-di[2-(4-hydroxy-3-alkylphenyl)-2-propyl]benzene
1,3-di[2-(2,4-dihydroxyphenyl)-2-propyl]benzene
1,3-di[2-(2-hydroxy-5-methylphenyl)-2-propyl]benzene
<Resorcinol type>
1,3-dihydroxy-6(α, α-dimethylbenzyl)-benzene.
<4-hydroxybenzoyloxybenzoic acid ester type>
4-hydroxybenzoyloxybenzyl benzoate
4-hydroxybenzoyloxymethyl benzoate 4-hydroxybenzoyloxyethyl benzoate
4-hydroxybenzoyloxypropyl benzoate
4-hydroxybenzoyloxybutyl benzoate
4-hydroxybenzoyloxyisopropyl benzoate
4-hydroxybenzoyloxytert-butyl benzoate
4-hydroxybenzoyloxyhexyl benzoate
4-hydroxybenzoyloxyoctyl benzoate
4-hydroxybenzoyloxynonyl benzoate
4-hydroxybenzoyloxycyclohexyl benzoate
4-hydroxybenzoyloxy β-phenethyl benzoate
4-hydroxybenzoyloxyphenyl benzoate
4-hydroxybenzoyloxy α-naphthyl benzoate
4-hydroxybenzoyloxy β-naphthyl benzoate
4-hydroxybenzoyloxy sec-butyl benzoate
<Bisphenolsulfone type (I)>
bis-(3-1-butyl-4-hydroxy-6-methylphenyl)sulfone
bis-(3-ethyl-4-hydroxyphenyl)sulfone
bis-(3-propyl-4-hydroxyphenyl)sulfone
bis-(3-methyl-4-hydroxyphenyl)sulfone
bis-(2-isopropyl-4-hydroxyphenyl)sulfone
bis-(2-ethyl-4-hydroxyphenyl)sulfone
bis-(3-chloro-4-hydroxyphenyl)sulfone
bis-(2,3-dimethyl-4-hydroxyphenyl)sulfone
bis-(2,5-dimethyl-4-hydroxyphenyl)sulfone
bis-(3-methoxy-4-hydroxyphenyl)sulfone
4-hydroxyphenyl-2'-ethyl-4'-hydroxyphenylsulfone
4-hydroxyphenyl-2'-isopropyl-4'-hydroxyphenylsulfone
4-hydroxyphenyl-3'-isopropyl-4'-hydroxyphenylsulfone
4-hydroxyphenyl-3'-sec-butyl-4'-hydroxyphenylsulfone
3-chloro-4-hydroxyphenyl-3'-isopropyl-4'-hydroxyphenylsulfone
2-hydroxy-5-t-butylphenyl-4'-hydroxyphenylsulfone
2-hydroxy-5-t-aminophenyl-4'-hydroxyphenylsulfone
2-hydroxy-5-t-isopropylphenyl-4'-hydroxyphenylsulfone
2-hydroxy-5-t-octylphenyl-4'-hydroxyphenylsulfone
2-hydroxy-5-t-butylphenyl-3'-chloro-4'-hydroxyphenylsulfone
2-hydroxy-5-t-butylphenyl-3'-methyl-4'-hydroxyphenylsulfone
2-hydroxy-5-t-butylphenyl-3'-isopropyl-4'-hydroxyphenylsulfone
2-hydroxy-5-t-butylphenyl-2'-methyl-4'-hydroxyphenylsulfone
<Bisphenolsulfone type (II)>
4,4'-sulfonyldiphenol
2,4'-sulfonyldiphenol
3,3'-dichloro-4,4'-sulfonyldiphenol
3,3'-dibromo-4,4'-sulfonyldiphenol
3,3',5,5'-tetrabromo-4,4'-sulfonyldiphenol
3,3'-diamino-4,4'-sulfonyldiphenol
<others>
p-tert-butylphenol
2,4-dihydroxybenzophenone
novolac type phenolic resin
4-hydroxyacetophenone
p-phenylphenol
benzyl-4-hydroxyphenylacetate
p-benzylphenol
4,4'-bis(p-tolylsulfonylaminocarbonilamino)diphenylmethane
4,4'-bis(phenylaminotiocarbonylamino)diphenylsufide Further, metallic chelate type color developing component composed of high fatty acid metal complex salt and multi valence hydroxyl aromatic compound mentioned in Japanese Patent Laid-open Publication 10-258577 can be used as an image forming material. These chelate type color developing component can be used alone or can be used together with leuco dye and organic color developer.

And, in general, in the thermally sensitive recording medium, a sensitizer can be added aiming to improve the sensitivity. Specific examples are mentioned as follows, however not intending to be limited to these compounds, and can be used together with.

For example, stearic acid amide,
methoxycarbonyl-N-benzamidestearate,
N-benzoyl stearic acid amide,
N-icosenic acid amide,
ethylene-bis-stearic acid amide,
behenic acid amide,
methylene-bis-stearic acid amide,
methylolamide,
N-methylolsteric acid amide,
dibenzylterephthalate,
dimethylterephthalate,
dioctylterephthalate,
p-benzyloxybenzylbenzoate,
1-hydroxy-2-phenylnaphthoate,
dibenzyloxalate
di-p-methylbenzyloxalate,
di-p-chlorobenzyloxalate,
2-naphthylbenzylether,
m-tarphenyl,
p-benzylbiphenyl,
1,2-bis(phenoxymethyl)benzene <PMB-2>,
Tolylbiphenylether,
di(p-methoxyphenoxyethyl)ether,
1,2-di(3-methylphenoxy)ethane,
1,2-di(4-methylphenoxy)ethane,
1,2-di(4-methoxyphenoxy)ethane,
1,2-di(4-chlorophenoxy)ethane,
1,2-diphenoxyethane,
1-(4-methoxyphenoxy)-2-(2-methylphenoxy)ethane,
p-methylthiophenylbenzylether,
1,4-di(phenylthio)butane,
p-acetotoluidide,
p-acetophenetidide,
N-acetoacetyl-p-toluidine,
di-(β-biphenylethoxy)benzene,
p-di(vinyloxyethoxy)benzene and 1-isopropylphenyl-2-phenylethane can be mentioned. Generally, 0.1-10 weight parts of these sensitizers is used to 1 weight part of total weight of dye precursor contained as complex fine particles and solid fine particles.

To the multi colored thermally sensitive recording medium of the present invention, a preserving stabilizer can be used for the purpose to stabilize the medium during preservation term. As the specific example, hindered phenol compound such as,
1,1,3,-tris(2-methyl-4-hydroxy-5-tert-butylphenyl)butane
1, 1,3,-tris(2-methyl-4-hydroxy-5-cyclohexylphenyl)butane
4,4'-buthylidenebis(2-tert-butyl-5-methylphenol),
4,4'-thiobis(2-tert-butyl-5-methylphenol),
2,2'-thiobis(6-tert-butyl-4-methylphenol) or
2,2'-methylenebis(6-tert-butyl-4-methylphenol),
4-benziloxy-4'-(2-methylglycidiloxy)diphenylsulfone or sodium 2,2'-methylenebis(4,6-di-tert-butylphenyl)phosphate can be mentioned. In general, 0.1-10 weight parts of these preserving stabilizer is used to 1 weight part of total weight of dye precursor contained as complex fine particles and solid fine particles.

As the specific example of a binder used in the multi colored thermally sensitive recording medium, starches, hydroxyethyl cellulose, methyl cellulose, carboxymethyl cellulose, gelatin, casein, gum arabic, polyvinylalcohol, denatured polyvinyl alcohol by carboxyl, denatured polyvinyl alcohol by acetoacetyl group, denatured polyvinyl alcohol by silicon, alkaline salt of isobutylene-maleic anhydride copolymer, alkaline salt of styrene-maleic anhydride copolymer, alkaline salt of ethylene-maleic anhydride copolymer or alkaline salt of styrene-acrylic acid copolymer, latexes such as styrene-butadiene copolymer or acrylonitrile-butadiene copolymer, water dispersible binder such as urea resin, melamine resin, amide resin or polyurethane resin can be mentioned.

As the specific example of a filler, an inorganic filler such as activated clay, clay, calcined clay, talc, kaoline, calcined kaoline, calcium carbonate, magnesium carbonate, barium carbonate, titanium dioxide, zinc oxide, silicone oxide or aluminum hydroxide, or an organic filler such as urea-formaldehyde resin, polystyrene resin or phenol resin can be used.

Still more, a dispersing agent such as sodiumdioctylsulfosuccinate, surface active agent, defoamer, fluorescent brightening agent, slipping agent, UV absorbing agent or antioxidant can be used if desired.

As the substrate used for the thermally sensitive recording medium of the present invention, paper such as wood free paper, middle grade paper, recycled paper or coated paper can be mainly used, however, various non-woven cloth, plastic film, synthetic paper metal foil or a complex sheet combining these sheets can be also voluntarily used.

Furthermore, it is possible to form an over coat layer composed of polymer compound over the thermally sensitive recording layer for the purpose to improve the preserving property, and an under coat layer composed of polymer compound containing a filler under the thermally sensitive recording layer for the purpose to improve the color developing sensitivity. It is also possible to form an intermediate layer between the thermally sensitive recording layer and the over coat layer.

Using above mentioned various materials, the multi colored thermally sensitive recording medium of the present invention can be prepared by conventional public known method. The method for preparation of the coating for each layer of the thermally sensitive recording medium is not restricted, and can be prepared by using water as the dispersing medium, mixing dye precursor complex fine particles, organic color developer, binder and filler and slipping agent which are added when need is arisen and by stirring. Ordinary, these materials are separately ground and dispersed in water using a sand grinder, an attriter or a ball mill then mixed, thus the aqueous coating can be obtained. The ratio of dye precursor and color developing agent is voluntarily selected along with the kind of dye precursor and color developer and is not restricted, however, 1-50 weight parts, desirably 2-10 weight parts to 1 weight part of total weight of dye precursor contained as complex fine particles and solid fine particles is used. Regarding a binder, in the range of 15-80 weight parts to total solid amount of each layer is used. Further, the ratio of solid state dye precursor to dye precursor in the complex fine particles is not restricted, however, desirably 0.5-3 weight %.

The method for formation of each layer is not restricted, and for example, air knife coating, Valiber blade coating, pure blade coating, rod blade coating, short dwell coating, curtain coating or die coating can be voluntarily selected. For example, a coating for thermally sensitive recording layer is coated on a substrate and dried, then a coating for over coat layer is coated over the thermally sensitive recording layer and dried. Further, the coating amount of the coating for thermally sensitive recording layer is approximately 2-12 g/m$^2$, desirably 3-10 g/m$^2$ by dry weight and, the coating amount of the coating for under coat layer, intermediate layer or over coat layer is adjusted in the range of 0.1-15 g/m$^2$ around, desirably 0.5-7 g/m$^2$ around by dry weight.

Furthermore, the thermally sensitive recording medium of the present invention is possible to provide a back coat layer at the reverse side of the substrate so as to improve the preservability more. Still further, after each layer is formed, it is possible carry out the smoothing treatment such as super calendaring.

The multi colored thermally sensitive recording medium of the present invention can be applied in the field in which thermally sensitive recording medium is ordinary used, for example, facsimile paper for business use or personally use, POS, trading, label for industrial use, printing paper to be used for a word processor, printing paper to be used for a resistor of super market, printing paper for medical measuring instrument, printing paper for industrial measurement, ATM paper used in a bank or for ticket paper.

EXAMPLE

The thermally sensitive recording medium of the present invention will be illustrated more actually according to the Examples and the Comparative Examples, however, not intended to be limited to them. In the Examples and the Comparative Examples, "parts" and "%" indicates "weight parts" and "weight %".

[Synthesis of Complex Fine Particle A]

10 parts of 3-(N-isobutyl-N-ethylamino)-6-methyl-7-anilinofluoran <PSD-184> and 0.8 parts of 4,4'-diisocyanate-3,3'-dimethyl-1,1'-biphenyl (TOD1, product of Nihon Soda) were dissolved in 20 parts of ethylacetate at 60-70° C., 9.6 parts of adduct of molar ratio 3:1 of xylilenediisocyanate and trimethylol propane (product of Mitsui Takeda, TAKENATE D110N, 75 weight % ethyl acetate solution) was added and mixed homogeneously. Then, this mixture was added gradually to 55 parts of 6% aqueous solution of polyvinylalcohol (product of Kuraray, PVA-217) which was agitating by 9000 R.P.M. using a homogenizer and emulsified. Then 80 parts of water was added, and ethylacetate was removed by heating this dispersion at 60° C. for 2 hours and isocyanate was polymerized by stirring at 70° C. for 3 hours. Thus the dispersion (20%) of complex fine particles A whose average particle size is 0.5 μm were prepared.

[Synthesis of Complex Fine Particle B]

By same method to the complex fine particle A except using polymethylene.polyphenyl.polyisocyanate (product of Nihon Polyurethane Industries Co., Ltd., MILLIONATE MR.200) instead of 4,4'-diisocyanate-3,3'-dimethyl-1,1'-biphenyl, the dispersion (20%) of complex fine particles B whose average particle size is 0.5 μm were prepared.

[Synthesis of Complex Fine Particle C]

By same method to complex fine particle A except changing 0.8 parts of 4,4'-diisocyanate-3,3'-dimethyl-1,1'-biphenyl to 1.6 parts, 9.6 parts of adduct of molar ratio 3:1 of xylilenediisocyanate and trimethylol propane to 8.5 parts, the dispersion (20%) of complex fine particles C whose average particle size is 0.5 μm were prepared.

[Synthesis of Complex Fine Particle D]

By same method to complex fine particle A except changing 0.8 parts of 4,4'-diisocyanate-3,3'-dimethyl-1,1'-biphenyl to 3.2 parts, 9.6 parts of adduct of molar ratio 3:1 of xylilenediisocyanate and trimethylol propane to 6.4 parts, the dispersion (20%) of complex fine particles D whose average particle size is 0.5 μm were prepared.

[Synthesis of Complex Fine Particle E]

By same method to complex fine particle A except changing 3-(N-isobutyl-N-ethylamino)-6-methyl-7-anilinofluoran <PSD-184> to 3-(N-isopentyl-N-ethylamino)-6-methyl-7-anilinofluoran <PSD-205>, the dispersion (20%) of complex fine particles E whose average particle size is 0.5 μm were prepared.

[Synthesis of Complex Fine Particle F]

By same method to complex fine particle A except changing 0.8 parts of 4,4'-diisocyanate-3,3'-dimethyl-1,1'-biphenyl to 4.8 parts, 9.6 parts of adduct of molar ratio 3:1 of xylilenediisocyanate and trimethylol propane to 4.3 parts, the dispersion (20%) of complex fine particles E whose average particle size is 0.5 μm were prepared.

[Synthesis of Complex Fine Particle G]

By same method to complex fine particle A except using 0.4 parts of 4,4'-diisocyanate-3,3'-dimethyl-1,1'-biphenyl and 0.4 parts of polymethylene.polyphenyl.polyisocyanate (product of Nihon Polyurethane Industries Co., Ltd., MILLIONATE MR.200) instead of 0.8 parts of 4,4'-diisocyanate-3,3'-dimethyl-1,1'-biphenyl, the dispersion (20%) of complex fine particles G whose average particle size is 0.5 μm were prepared.

[Synthesis of Complex Fine Particle H]

By same method to complex fine particle A except changing 0.8 parts of 4,4'-diisocyanate-3,3'-dimethyl-1,1'-biphenyl to 0 part and 9.6 parts of adduct of molar ratio 3:1 of xylilenediisocyanate and trimethylol propane to 10.7 parts, the dispersion (20%) of complex fine particles G whose average particle size is 0.5 μm were prepared.

[Synthesis of Complex Fine Particle I]

By same method to complex fine particle A except changing 10 parts of 3-(N-isobutyl-N-ethyllamino)-6-methyl-7-anilinofluoran <PSD-184> to 5 parts of 3-(N-isobutyl-N-ethyllamino)-6-methyl-7-anilinofluoran <PSD-184> and 5 parts of 3-(N-isopentyl-N-ethyllamino)-6-methyl-7-anilinofluoran <PSD-205>, the dispersion (20%) of complex fine particles I whose average particle size is 0.5 μm were prepared.

Example 1

| ① solution (dispersion of red color dye precursor) | |
|---|---|
| 3,3'-bis(1-n-butyl-2-methylindol-3-yl)phthalide <Red 40> | 30.0 parts |
| 10% aqueous solution of polyvinylalcohol | 50.0 parts |
| Water | 20.0 parts |

Mixture of above mentioned components was ground to average particle size of 1 μm using a sand grinder.

| ② solution (dispersion of color developing agent) | |
|---|---|
| 4-hydroxy-4'-isopropoxydiphenylsulfone <D-8> | 30.0 parts |
| 10% aqueous solution of polyvinylalcohol | 20.0 parts |
| Water | 10.0 parts |

Mixture of above mentioned components was ground to average particle size of 1 μm using a sand grinder.

| ③ solution (dispersion of sensitizer) | |
|---|---|
| 1,2-bis(phenoxymethyl)benzene <PMB-2> | 30.0 parts |
| 10% aqueous solution of polyvinylalcohol | 20.0 parts |
| Water | 10.0 parts |

Mixture of above mentioned components was ground to average particle size of 1 μm using a sand grinder.

Then said dispersions were mixed by following ratio and a coating was prepared.

| | |
|---|---|
| Black color complex fine particles A dispersion | 32.0 parts |
| ① solution (dispersion of red color dye precursor) | 10.0 parts |
| ② solution (dispersion of color developing agent) | 12.0 parts |
| ③ solution (dispersion of sensitizer) | 20.0 parts |
| 30% dispersion of silica | 40.0 parts |

The obtained coating was coated on the one surface of 60 g/m$^2$ paper using a Mayer bar so as the coating amount to be 6.0 g/m$^2$ and dried, and the thermally sensitive recording medium was prepared.

Example 2

By same process to Example 1 except using black color complex fine particles B dispersion instead of black color complex fine particles A, the thermally sensitive recording medium was prepared.

Example 3

By same process to Example 1 except using black color complex fine particles C dispersion instead of black color complex fine particles A, the thermally sensitive recording medium was prepared.

Example 4

By same process to Example 1 except using black color complex fine particles D dispersion instead of black color complex fine particles A, the thermally sensitive recording medium was prepared.

Example 5

By same process to Example 1 except using black color complex fine particles E dispersion instead of black color complex fine particles A, the thermally sensitive recording medium was prepared.

Example 6

By same process to Example 1 except using black color complex fine particles F dispersion instead of black color complex fine particles A, the thermally sensitive recording medium was prepared.

Example 7

By same process to Example 1 except using black color complex fine particles G dispersion instead of black color complex fine particles A, the thermally sensitive recording medium was prepared.

Example 8

By same process to Example 1 except using black color complex fine particles I dispersion instead of black color complex fine particles A, the thermally sensitive recording medium was prepared.

Comparative Example 1

By same process to Example 1 except using black color complex fine particles H dispersion instead of black color complex fine particles A, the thermally sensitive recording medium was prepared.

[Evaluation Test]

The evaluation tests were carried out on the obtained specimen of multi colored thermally sensitive recording medium as follows. Results are summarized in Table 1.

Color Developing Ability

Thermal printer of MARKPOINT Co., Ltd. (thermal head of ROHM Co., Ltd. is installed) is used. No. 4 position (applied energy is 0.076 mj/dot) is used as the lower temperature color developing and No. 11 position (applied energy is 0.219 mj/dot) is used as the higher temperature color developing and image is printed. The obtained image is measured by Macbeth densitometer (RD-914). Red color image (lower temperature developed color image) is indicated by density (M-C value) which is the value subtracted the value using a red filter from the value using green filter, while black color image (higher temperature developed color image) is indicated by density (C value) using red filter. Developed color tone is also inspected by appearance.

TABLE 1

| | Macbeth density | | Appearance | |
|---|---|---|---|---|
| | Red color (M − C value) | Black color (C value) | Red color | Black color |
| Example 1 | 1.06 | 1.35 | ○ | ○ |
| Example 2 | 1.12 | 1.30 | ○ | ○ |
| Example 3 | 1.09 | 1.33 | ○ | ○ |
| Example 4 | 1.12 | 1.30 | ○ | ○ |
| Example 5 | 1.03 | 1.36 | ○ | ○ |
| Example 6 | 1.15 | 1.20 | ○ | Δ |
| Example 7 | 1.09 | 1.33 | ○ | ○ |
| Comparative Example 1 | 0.90 | 1.36 | Δ | ○ |

TABLE 1-continued

| | Macbeth density | | Appearance | |
|---|---|---|---|---|
| | Red color (M − C value) | Black color (C value) | Red color | Black color |

Color tone of color developed part ○ : clear color developing (evaluation by appearance) Δ : mixed color developed or lower density developing

INDUSTRIAL APPLICABILITY

As mentioned above, the multi colored thermally sensitive recording medium, the color tones which are developed at lower temperature color development and higher temperature color development are vivid, and there is no fogging between lower temperature developed color tone and higher temperature developed color tone and is excellent in color separation. Especially, in the case of two or more color tones which are largely different such as black and red, each color tone is respectively very vivid and the excellent image can be obtained.

The invention claimed is:

1. A multi colored thermally sensitive recording medium comprising, a thermally sensitive recording layer containing two or more kinds of colorless or pale colored dye precursors which develop different color tones and organic color developing agent which develops color by reacting with said dye precursor provided on a substrate, wherein at least one of said dye precursor is contained in complex fine particles which contain dye precursor and polymer of multi valence isocyanate compound, and said thermally sensitive recording layer further contains 4,4'-diisocyanate-3,3'-dimethyl-1,1'biphenyl and/or polymethylene.polyphenyl.polyisocyanate as said multi valence isocyanate compound.

2. The multi colored thermally sensitive recording medium of claim 1, wherein 4,4'-diisocyanate-3,3'-dimethyl-1,1'biphenyl and/or polymethylene.polyphenyl.polyisocyanate is contained from 5 weight % to 50 weight % to the total weight of multi valence isocyanate compound.

3. The multi colored thermally sensitive recording medium of claim 1, wherein the complex of fine particles contains black color developing dye precursor and polymer of multi valence isocyanate.

4. The multi colored thermally sensitive recording medium of claim 2, wherein the complex of fine particles contains black color developing dye precursor and polymer of multi valence isocyanate.

* * * * *